US006933024B2

(12) United States Patent
Chen

(10) Patent No.: US 6,933,024 B2
(45) Date of Patent: Aug. 23, 2005

(54) WATER SOLUBLE POLYMERS AS INKJET RECORDING MATERIALS

(75) Inventor: Tienteh Chen, San Dieg, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/199,879

(22) Filed: Jul. 18, 2002

(65) Prior Publication Data

US 2004/0013825 A1 Jan. 22, 2004

(51) Int. Cl.[7] ..... B41M 5/40
(52) U.S. Cl. ..... 428/32.28; 428/32.26; 428/32.34; 428/32.38; 524/803
(58) Field of Search ..... 428/32.26, 32.28, 428/32.34, 32.38; 524/803

(56) References Cited

U.S. PATENT DOCUMENTS

| | | | | |
|---|---|---|---|---|
| 3,635,718 | A | * 1/1972 | Froehlich et al. | 96/111 |
| 4,063,952 | A | * 12/1977 | Himmelmann et al. | 96/111 |
| 4,425,405 | A | 1/1984 | Murakami et al. | |
| 4,478,910 | A | 10/1984 | Oshima et al. | |
| 4,503,111 | A | 3/1985 | Jaeger et al. | |
| 4,547,405 | A | 10/1985 | Bedell et al. | |
| 4,575,465 | A | 3/1986 | Viola | |
| 4,592,951 | A | 6/1986 | Viola | |
| 4,686,118 | A | 8/1987 | Arai et al. | |
| 4,780,356 | A | 10/1988 | Otouma et al. | |
| 5,141,797 | A | * 8/1992 | Wheeler | 428/195 |
| 5,283,129 | A | * 2/1994 | Renk et al. | 428/537.5 |
| 5,529,892 | A | * 6/1996 | Massirio et al. | 430/523 |
| 5,536,994 | A | 7/1996 | Tong et al. | |
| 5,717,281 | A | 2/1998 | Tong et al. | |
| 6,165,606 | A | * 12/2000 | Kasahara et al. | 428/323 |
| 6,183,851 | B1 | * 2/2001 | Mishima | 428/304.4 |
| 6,500,527 | B2 | * 12/2002 | Miller | 42/195 |
| 6,533,408 | B1 | * 3/2003 | Erdtmann et al. | 347/100 |
| 2002/0022118 | A1 | 2/2002 | Sarkar et al. | |
| 2003/0096087 | A1 | * 5/2003 | Benenati et al. | 428/195 |
| 2003/0143344 | A1 | * 7/2003 | Yau et al. | 428/32.1 |
| 2003/0180523 | A1 | * 9/2003 | Parrinello et al. | 428/315.5 |

FOREIGN PATENT DOCUMENTS

| | | |
|---|---|---|
| EP | 0919395 A2 | 6/1999 |
| EP | 1059173 A2 | 12/2000 |

OTHER PUBLICATIONS

"N–Vinylamide Polymers"; by: Robert B. Login, Sybron Chemicals Inc.; Jun. 4, 2002; http://www.mrw.interscience.wiley.com/kirk/articles/vinylogi.a02/sect17.html.

* cited by examiner

*Primary Examiner*—B. Shewareged

(57) ABSTRACT

The use and preparation of poly(vinylpyrrolidone (PVP)-co-vinylalcohol (PVA)) as inkjet recording material, the method of making PVP/PVA copolymer comprising the steps of: hydrolyzing PVP/polyvinyl acetate (PVAc) copolymer with a mixture comprising water, at least one alcohol and at least one strong base.

24 Claims, No Drawings

WATER SOLUBLE POLYMERS AS INKJET RECORDING MATERIALS

FIELD OF THE INVENTION

The application relates to the use and preparation of poly(vinylpyrrolidone (PVP)-co-vinylalcohol (PVA)) as inkjet recording material.

BACKGROUND OF THE INVENTION

Ink jet printers, that is to say, printers which form an image by firing a plurality of discrete drops of ink from one or more nozzles on to the surface of a recording sheet placed adjacent the nozzles, have recently enjoyed a large increase in sales. Such ink jet printers have the advantage that they can reproduce good quality text and images, in both monochrome and full color, can produce both reflection prints and transparencies, and are relatively inexpensive to manufacture and to operate. Accordingly, ink jet printers now dominate the home/small office market, and are often also used to provide color capability not available from the monochrome laser printers typically employed in larger offices.

Although modern ink jet printers can print on almost any conventional paper or similar medium, and indeed are routinely used with commercial photocopying paper for printing text, the quality of images produced by such printers is greatly affected by the properties of the medium used. To produce high quality images reliably, it is necessary that the medium (ink jet recording sheet) dry rapidly since otherwise the ink is likely to smear when successive sheets are stacked in the output tray of the printer. On the other hand, the medium should not promote excessive spreading of the ink droplet, since such spreading reduces image resolution and may result in color distortion if adjacent ink droplets intermix. The medium also should not promote "wicking", that is to say, spreading of ink by capillary action through fibrous media, such as paper. The medium must be capable of absorbing the ink without substantial distortion of the medium, since otherwise unsightly "cockling" (formation of ripples and similar folds) may occur, and most observers find such distortions unacceptable. Once the ink has dried, the medium should be such that contact of the image with moist surfaces (such as sweaty fingers) does not result in bleeding of ink from the image. Finally, since the surface characteristics, such as smoothness, glossiness and feel, of the image are largely determined by the same characteristics of the medium, the medium should possess characteristics appropriate to the type of image being printed. When, as is increasingly common, an ink jet printer is used to print a digital image produced by a camera or a scanner, the medium should be smooth and possess the high gloss and smooth feel of conventional silver-halide based photographic printing paper.

There are two types of ink jet medium, i.e. reflection type displays (prints) and transmission type displays (transparency). Substrate used for prints in general are coated paper or resin coated paper. Substrate used for transparency in general are plastic films, such as cellulose acetate and polyesters. To improve the affinity of the ink with the medium and to improve the image quality and the durability of the prints, water soluble polymers with or without pigments are commonly used. Polyvinyl alcohol and polyvinyl pyrrolidone are among the most common polymers used for the inkjet recording materials.

Copolymers with vinylpyrrolidone are known. Poly (vinylpyrrolidone-co-vinyl acetate), a product of copolymerization of vinylpyrrolidone and vinyl acetate was the first commercially successful class of copolymer of vinylpyrrolidone and is currently manufactured in commercial quantities by both ISP Chemical Corporation (ISP) and BASF AG (BASF). Copolymers of vinylpyrrolidone with various other monomers are also known. The best known include dimethylaminoethyl methacrylate (DMAEMA), methylvinylimidazolium chloride (Polyquaternium 16), methacrylamidopropyltrimethyl ammonium chloride (Polyquaternium 28), acrylic acid (AA), alpha-olefins, and styrene. (Kirk-Othmer Encyclopedia of Chemical Technology, N-Vinylamide Polymers: 7. Copolymerization, http://www.mrw.interscience.wiley.com/kirk/articles/vinylogi.a02/sect17.html.) However, these copolymers do not have adequate image quality and usually have poor smudge and finger print resistance.

SUMMARY OF THE INVENTION

The present invention relates to a method of making a polyvinyl pyrrolidone (PVP)/polyvinyl alcohol (PVA) copolymer comprising the steps of:

a) hydrolyzing PVP/polyvinyl acetate (PVAc) copolymer with a mixture comprising water, at least one alcohol and at least one strong base. The present invention also relates to the PVP/PVA copolymer made by the above method.

The present invention also relates to a method of using PVP/PVA copolymer as inkjet print media comprising the steps of:

a) hydrolyzing PVP/PVAc copolymer with a mixture comprising water, at least one alcohol and at least one strong base to make a PVP/PVA copolymer;
b) producing at least one sheet of print media from a composition comprising the hydrolyzed PVP/PVA copolymer;
c) inkjet printing the at least one sheet of print media.

The present invention further relates to a PVP/PVA copolymer comprising from about 1 to about 50 weight percent PVP and from about 50 to about 99 weight percent PVA.

In addition, the present invention relates to inkjet print media comprising at least one layer of a PVP/PVA copolymer.

DETAILED DESCRIPTION

Some of the most common water-soluble polymers for the swellable inkjet media are gelatin, PVA, PVP, and poly (ethyleneoxide), and their mixtures. Blending two or more of these polymers is commonly done, but compatibility problems are frequently encountered. Incompatibility results in poor coating and image quality.

Out of all these water-soluble polymers, only gelatin and PVA are crosslinkable. Because of this lack of crosslinkability, the polymers have poor waterfastness. Specific disadvantages of PVP can include (but are not limited to): tackiness, poor lightfastness, poor smudge resistance, and poor fingerprint resistance. Specific disadvantages of PVA include (but are not limited to): poor image quality, poor drying, poor coalescence and poor ink absorption rate.

The applicant has discovered that the copolymer of PVP and PVA prepared from the hydrolysis of a PVP-co-poly (vinylester), preferably PVP-co-poly(vinylacetate), combines the advantages of both polymers but also greatly overcomes the disadvantages of either polymer. It also solves the incompatibility between these two polymers.

Unlike PVP, the poor smudge resistance and poor water fastness of PVP/PVA copolymers can be improved with crosslinking. Typical crosslinking agents include monoaldehyde (e.g. formaldehyde, acetaldehyde, benzaldehyde, etc.), dialdehyde (glutaraldehyde, glyoxal, succinic dialdehyde), trimethylol melamine, urea-formaldehyde, blocked aldehyde (e.g. Curesan™200 by BASF), polyac-rolein, boric acid and borate (such as borates, methyl borate, boron trifluoride, boric anhydride, pyroborates, peroxoborates and boranes). Other potential crosslinking agents include N-lactam carboxylates, dicarboxylic acids (maleic acid or oxalic acid), di-isocyanates, divinyl sulphate, and inorganic compounds such as germanic acids and germanates, titanium salts and esters, chromates and vanadates, cupric salts and other Group IB salts. The crosslinking agents can be added to the solution of PVP/PVA directly, but sometimes it is preferred to coat the solution of crosslinking agents on the top of PVP/PVA coating to avoid coating defects. Such crosslinking improves the smudge resistance and stackability of the coating. In addition, ink absorption rates and image quality (e.g. coalescence) are improved with the incorporation of PVP into the PVA backbone. The amount of crosslinking agents used is from 0.1% to 5% based on the weight of PVP/PVA co-polymers.

The composition of PVP/PVA copolymer ranges from about 1 to about 50 weight percent PVP and from about 50 to about 99 weight percent PVA, preferably from about 5 to about 30 percent of PVP and from about 70 to about 95 percent of PVA. They can be used for swellable media or porous media. In swellable media, PVP/PVA copolymer can be used by itself or in combination with other water-soluble polymers such as gelatin, PVA, PVP, poly(ethyleneoxide), cationic or acetoacetylated PVA, hydroxyethyl cellulose, hydroxyl methyl cellulose, etc. In porous media PVP/PVA can be used as binders for inorganic pigments, like silica and alumina. Non-limiting, specific examples of the inorganic pigments that can be used for the porous inkjet materials include fine particles of silica, aluminosilicate, alumina (in the alpha, theta, gamma, and/or delta-forms), silica boria and magnesium silicate. The inorganic pigment particles can be primary and/or secondary particles, such as colloidal, fumed or precipitated inorganic pigments. The particle size of the inorganic pigments should be less than 1 $\mu$m. Preferred inorganic pigments used for inkjet recording materials are fumed silica and boehmite (gamma-alumina. The ratio of PVP/PVA and inorganic pigments should be from about 5 to about 30% by weight. PVP/PVA copolymers can be used in single layer coatings or multilayer coatings.

The PVP/PVA copolymer of this invention can be prepared by the hydrolysis of polyvinylpyrrolidone-co-polyvinylester (PVP/Polyvinyl ester) copolymers in the presence of strong base, alcohol and water. The polyvinylester used can be selected from the group consisting of vinyl acetate, vinyl pivalate, vinyl propionate, vinyl 2-ethylhexanoate, and vinyl versatate (VeoVa 10 by Resolution Performance Products LLC, formerly Shell Resins and Versatics). In a preferred embodiment, vinyl acetate is used. Examples of the strong base include NaOH, KOH, $NH_4OH$, etc. The maximum equivalent of base used for the hydrolysis should be equal to or less than the equivalent of the amount of vinyl ester in the PVP/Polyvinyl ester.

Examples of alcohols include methanol, ethanol, 2-propanol, 1-butanol, etc. Methanol is the favorite. PVP/Polyvinyl ester copolymer can be prepared from the free radical polymerization of n-vinyl pyrrolidone and vinyl ester, such as vinyl acetate, in the water/alcohol mixture.

The polymerization can be initiated with a typical water soluble thermal initiators and redox initiators.

Examples of thermal initiators include persulfate such as sodium, potassium and ammonium persulfate and water soluble azo initiators.

Examples of the water-soluble azo initiators include 2,2'-Azobis[2-(5-methyl-2-imidazolin-2-yl)propane] dihydrochloride, 2,2'-Azobis[2-(2-imidazolin-2-yl)propane disulfate dehydrate, 2,2'-Azobis[N-(2-carboxyethyl)-2-methylpropionamidine] tetrahydrate, 2,2'-Azobis[N-(2-carboxyethyl)-2-methylpropionamidine] tetrahydrate, 2,2'-Azobis{2-[1-(2-hydroxyethyl)-2-imidazolin-2-yl] propane}dihydrochloride, 2,2'-Azobis{2-methyl-N-[1,1-bis(hydroxymethyl)-2-hydroxyethyxl]propionamide, 2,2'-Azobis[2-methyl-N-(2-hydroxyethyl)propionamide], 2,2'-Azobis[2-(2-imidazolin-2-yl)propane]dihydrochloride, 2,2'-Azobis(2-methylpropionamide)dihydrochloride, 2,2'-Azobis[2-(3,4,5,6-tetrahydropyrimidin-2-yl)propane] dihydrochloride, 2,2'-Azobis[2-(2-imidazolin-2-yl)propane], 2,2'-Azobis{2-methyl-N-[2-(1-hydroxybuthyl)] propionamide}.

Examples of redox initiators include persulfate-bisulfite, persulfate-hydrosulfite, persulfate/Iron (II), persulfate-pyrosulfite-thiosulfate with Cu(II), and sodium formaldehyde sulfoxylate with cumene hydroperoxide, tert-butyl hydroperoxide, diisopropylbezene hydroperoxide. The polymerization temperature range from ambient temperature to 60° C. (redox initiators) and from 60 to 90° C. (for thermal initiators).

Typical procedures for the preparation of PVP/PVA copolymers from the PVP/PVAc copolymers are demonstrated below.

EXAMPLES

Example 1

Synthesis of PVP/PVA (70/30) Copolymer (P-1)

PVP/PVA copolymer was obtained by hydrolyzing PVP/PVAc (E-735) (70% PVP, 30% PVAc). This was accomplished by combining PVP/VAc with NaOH (1:1) in water/alcohol mixture. The specific amounts of the components are given below in Table 1.

TABLE 1

Hydrolysis of PVP/PVAc E-735 (by ISP)

| | wt (g) | Eq. (PVAc) |
|---|---|---|
| PVP/PVAc E-735 (50% in ethanol) | 100 | 0.178 |
| NaOH (30% in water) | 23.7 | 0.178 |
| Deionized water | 100 | |

The initial pH of the PVP/PVAc was 5.18 before the NaOH was added. The initial pH was 13.6 after the NaOH was added.

The hydrolysis reaction was conducted at 50–65° C. in a beaker equipped with a thermometer and pH meter.

The reaction time of the hydrolysis was approximately 3 hours. The final pH of the reaction was 8.7. The solution was then neutralized with 5% acetic acid to pH 7.0.

Example 2

Synthesis of PVP/PVA(50/50) Copolymer (P-2)

PVP/PVA copolymer was obtained by hydrolyzing PVP/PVAc E-535 (50% PVP, 50% PVAc). Reaction conditions were the same as for hydrolysis of E-735 and E-335 in Examples 1 and 2 respectively. Polymer did not precipitate when 30 ml water was added. 47 grams of 30% NaOH was added over 5 minutes. pH dropped from 13.0 fairly fast to 9.5. Remaining NaOH was also added. pH stopped at 12.2. 3 M HCl was added to bring down the pH to 7.2. The solution's color changed from light brown to pale yellowish.

The solution was stirred at 65–70° C. to remove ethanol. The specific amounts of the components are given below in Table 2.

TABLE 2

Hydrolysis of PVP/PVAc E-535 (by ISP)

| | wt (g) | Eq. (PVAc) |
|---|---|---|
| PVP/PVAc E-535 (50% in ethanol) | 152 | 0.44 |
| NaOH (30% in water) | 59 | 0.44 |
| Deionized water | 30 (after all NaOH added) | |

Example 3

Synthesis of PVP/PVA (30/70) Copolymer (P-3)

PVP/PVA copolymer was obtained by hydrolyzing PVP/PVAc E-335 (30% PVP, 70% PVAC). The reaction conditions were the same as for the synthesis of P-1 and P-2. The specific amounts of the components are given below in Table 3. The solution stayed clear when 37 g of water were added to warm E-335 solution in 50% ethanol. 30 grams of 30% NaOH was added first over 5 minutes. pH dropped rapidly from 12.5 to 7.7 after one hour. 6 g more of 30% NaOH was added further. pH dropped much more slowly to 11.0. Reaction was stopped with HCl to pH 7.0. The solution was cooled to room temperature.

TABLE 3

Hydrolysis of PVP/PVAc E-335 (by ISP)

| | wt (g) | Eq. (PVAc) |
|---|---|---|
| PVP/PVAc E-335 (50% in ethanol) | 74 | 0.30 |
| NaOH (30% in water) | 36 | 0.27 |
| Deionized water | 37 (added to warm E-335 solution) | |

Example 4

Polymer Purification

The polymer solutions obtained from Examples 1 to 3 were dialyzed against distilled water to remove electrolytes and solvents with a cellulose membrane (MW cut-off is 12,000–14,000) for 6 hours. The purified polymers solutions were concentrated to the desired % solid on a hot plate.

Example 5

Evidence of Polymer Conversion

Polymers prepared in Examples 1–3 and purified in Example 4 were coated on clear polyethylene terephthalate (PET) film. All original (unhydrolyzed) solutions (E-735, E-535, and E-335) gave clear, transparent coatings and were either water-resistant or became hazy with a water dripping test. In contrast, the hydrolyzed (dialyzed) solutions also gave clear transparent coatings but all washed out completely with the water dripping test. This indicated that all vinyl acetate had been successfully converted to vinyl alcohol.

Example 6

Evaluation of PVP/PVA Copolymers as Inkjet Recording Materials

PVP/PVA of this invention were used as ink absorption materials for inkjet printing. The detailed formulation is described in Table 6A (in parts) and Table 6B (in grams).

The formulations described in Table 6A and 6B were coated on a coated paper (200 g) with a Mylar rod to give a coat weight of 5 to 7 gram/$M^2$. The coating was dried and a diagnostic chart was printed with a HP Deskjet 970 printer. The quality of the printing was evaluated in four categories, i.e., gloss, image quality (IQ), coalescence, and smudge test. A numerical rating was given to each coating (5 being the best and 1 being the worst). The results are shown in Table 6C.

TABLE 6A

| Ingredients (parts) | 1 | 2 | 3 | 4 | 5 | 6 | 7 | 8 | 9 | 10 |
|---|---|---|---|---|---|---|---|---|---|---|
| P-1 | 100 | 0 | 0 | 0 | 0 | 0 | 0 | 0 | 0 | 0 |
| P-2 | 0 | 100 | 0 | 0 | 0 | 0 | 0 | 0 | 0 | 0 |
| P-3 | 0 | 0 | 100 | 0 | 0 | 0 | 0 | 0 | 0 | 0 |
| PVP/VA E735[a] | 0 | 0 | 0 | 100 | 0 | 0 | 0 | 0 | 0 | 0 |
| PVP/VA E535[a] | 0 | 0 | 0 | 0 | 100 | 0 | 0 | 0 | 0 | 0 |
| PVP K-30[b] | 0 | 0 | 0 | 0 | 0 | 100 | 0 | 30 | 50 | 0 |
| Celvol 205[c] | 0 | 0 | 0 | 0 | 0 | 0 | 100 | 70 | 50 | 0 |
| Curesan ™ 200[d] | 2.5 | 2.5 | 2.5 | 2.5 | 2.5 | 2.5 | 2.5 | 2.5 | 2.5 | 2.5 |
| Boric Acid | 2.5 | 2.5 | 2.5 | 2.5 | 2.5 | 2.5 | 2.5 | 2.5 | 2.5 | 2.5 |
| B34[e] | 10 | 10 | 10 | 10 | 10 | 10 | 10 | 10 | 10 | 10 |
| PVP/VA E335[a] | 0 | 0 | 0 | 0 | 0 | 0 | 0 | 0 | 0 | 100 |

[a]Polyvinylpyrrolidone-co-polyvinylacetate (Trade name of ISP chemical company).

[b]Polyvinylpyrrolidone (Trade name of ISP).

[c]Polyvinyl alcohol (Trade name of Celanese AG (Celanese)).

[d]Water soluble crosslinker for PVA (Trade name of BASF).

[e]Cationic mordant (Trade name of PPG Industries Inc. (PPG)).

TABLE 6B

Formulation for Inkjet Printing Materials

| Ingredients (in grams) | % Solid | Formulation Number 1 | 2 | 3 | 4 | 5 | 6 | 7 | 8 | 9 | 10 |
|---|---|---|---|---|---|---|---|---|---|---|---|
| P-1 | 11.4 | 45.767 | 0.000 | 0.000 | 0.000 | 0.000 | 0.000 | 0.000 | 0.000 | 0.000 | 0.000 |
| P-2 | 9.97 | 0.000 | 52.331 | 0.000 | 0.000 | 0.000 | 0.000 | 0.000 | 0.000 | 0.000 | 0.000 |
| P-3 | 9.13 | 0.000 | 0.000 | 45.716 | 0.000 | 0.000 | 0.000 | 0.000 | 0.000 | 0.000 | 0.000 |
| PVP/VA E735[a] | 25 | 0.000 | 0.000 | 0.000 | 31.304 | 0.000 | 0.000 | 0.000 | 0.000 | 0.000 | 0.000 |
| PVP/VA E535[a] | 50 | 0.000 | 0.000 | 0.000 | 0.000 | 15.052 | 0.000 | 0.000 | 0.000 | 0.000 | 0.000 |
| PVP K-30[b] | 30 | 0.000 | 0.000 | 0.000 | 0.000 | 0.000 | 26.087 | 0.000 | 7.828 | 13.343 | 0.000 |
| Celvol 205[c] | 31.4 | 0.000 | 0.000 | 0.000 | 0.000 | 0.000 | 0.000 | 24.924 | 17.447 | 12.462 | 0.000 |
| Curesan ™ 200 [d] | 50 | 0.261 | 0.261 | 0.209 | 0.391 | 0.391 | 0.391 | 0.391 | 0.391 | 0.391 | 0.391 |
| Boric Acid | 3 | 4.348 | 4.348 | 3.478 | 6.522 | 6.522 | 6.522 | 6.522 | 6.522 | 6.522 | 6.522 |
| B34[e] | 27.8 | 1.877 | 1.877 | 1.501 | 2.815 | 2.815 | 2.815 | 2.815 | 2.815 | 2.815 | 2.815 |
| PVP/VA E335[a] | 50 | 0.000 | 0.000 | 0.000 | 0.000 | 0.000 | 0.000 | 0.000 | 0.000 | 0.000 | 15.852 |
| Water | 0.00 | 7.748 | 1.184 | 9.095 | 18.967 | 34.620 | 24.185 | 25.348 | 24.999 | 24.766 | 34.620 |
| % Solid | | 10 | 10 | 8 | 15 | 15 | 15 | 15 | 15 | 15 | 15 |

[a]Polyvinylpyrrolidone-co-polyvinylacetate (Trade name of ISP).
[b]Polyvinylpyrrolidone (Trade name of ISP).
[c]Polyvinyl alcohol (Trade name of Celanese).
[d]Water soluble crosslinker for PVA (Trade name of BASF).
[e]Cationic mordant (Trade name of PPG).

TABLE 6C

| Sample # | Gloss | Image Quality (IQ) | Coalescence | Smudge Test | Remarks |
|---|---|---|---|---|---|
| 1 | 5 | 4 | 4 | 5 | Invention |
| 2 | 5 | 4 | 5 | 5 | Invention |
| 3 | 5 | 4 | 5 | 5 | Invention |
| 4 | 4 | 2 | 3 | 1 | Comparison |
| 5 | 2 | 4 | 3 | 2 | Comparison |
| 6 | 2 | 2 | 3 | 1 | Comparison |
| 7 | 2 | 1 | 1 | 5 | Comparison |
| 8 | 4 | 4 | 3 | 4 | Comparison |
| 9 | 5 | 4 | 3 | 4 | Comparison |
| 10 | 3 | 1 | 1 | 1 | Comparison |

The results above show that the PVP-PVA copolymers of this invention give the best results for overall gloss, IQ, coalescence, and smudge resistance in comparison to the PVP/PVAc copolymers, polyvinylalcohol (PVA), polyvinylpyrrolidone (PVP, or the blend of PVP and PVA).

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. An inkjet print media comprising at least one layer of PVP/PVA copolymer, wherein the at least one layer of PVP/PVA copolymer comprises from about 1 to about 50 weight percent PVP and from about 50 to about 99 weight percent PVA.

2. The media of claim 1, wherein the PVP/PVA copolymer is in a single layer.

3. The media of claim 1, wherein the PVP/PVA copolymer is in multiple layers.

4. The media of claim 1, wherein the at least one layer of PVP/PVA copolymer comprises from about 5 to about 30 weight percent of PVP and from about 70 to about 95 percent of PVA.

5. The media of claim 1, wherein the PVP/PVA copolymer in the at least one layer is crosslinked with a crosslinking agent selected from the group consisting of monoaldehyde, dialdehyde, trimethylol melamine, urea-formaldehyde, blocked aldehyde, polyacrolein, borates, N-lactam carboxylates, dicarboxylic acids, di-isocyanates, divinyl sulphate, and inorganic compounds.

6. The media of claim 5, wherein the monoaldehyde is selected from the group consisting of formaldehyde, acetaldehyde and benzaldehyde.

7. The media of claim 5, wherein the dialdehyde is selected from the group consisting of glutaraldehyde, glyoxal, and succinic dialdehyde.

8. The media of claim 5, wherein the borates are selected from the group consisting of boric acid, methyl borate, boron trifluoride, boric anhydride, pyroborates, peroxoborates and boranes.

9. The media of claim 5, wherein the dicarboxylic acids are selected from the group consisting of maleic acid and oxalic acid.

10. The media of claim 5, wherein the inorganic compounds are selected from the group consisting of germanic acids, germanates, titanium salts, titanium esters, chromates, vanadates, Group IB salts.

11. The media of claim 10, wherein the Group IB salts are cupric salts.

12. The media of claim 5, wherein the crosslinking agent is from about 0.1 to about 5% of the PVP/PVA copolymer weight.

13. The media of claim 1, wherein the media is a swellable media.

14. The media of claim 13, wherein the at least one layer of PVP/PVA copolymer is combined with water-soluble polymers selected from the group consisting of gelatin, PVA, PVP, poly(ethyleneoxide), cationic PVA, acetoacetylated PVA, hydroxyethyl cellulose, and hydroxyl methyl cellulose.

15. The media of claim 1, wherein the media is a porous media.

16. The media of claim 15, wherein the at least one layer of PVP/PVA acts as a binder for inorganic pigments.

17. The media of claim 16, wherein the inorganic pigments are selected from the group consisting of silica, aluminosilicate, alumina, silica-boria and magnesium silicate.

18. The media of claim 17, wherein the silica is in a particle form.

19. The media of claim 17, wherein the alumina is in a form selected from the group consisting of alpha, theta, gamma, and delta.

20. The media of claim 17, wherein the inorganic pigments are in a form selected from the group consisting of colloidal pigments, fumed pigments and precipitated pigments.

21. The media of claim 17, wherein the inorganic pigments are fumed silica.

22. The media of claim 17, wherein the inorganic pigments are boehmite.

23. The media of claim 17, wherein the inorganic pigments have a particle size less than about 1(m.

24. The media of claim 17, wherein the ratio of PVP/PVA to inorganic pigments is from about 5 to about 30%.

* * * * *